US010550456B2

(12) United States Patent
Hentschel et al.

(10) Patent No.: US 10,550,456 B2
(45) **Date of Patent: *Feb. 4, 2020**

(54) INTERCRYSTALLINE CORROSION-RESISTANT ALUMINIUM ALLOY STRIP, AND METHOD FOR THE PRODUCTION THEREOF

(71) Applicant: Hydro Aluminium Rolled Products GmbH, Grevenbroich (DE)

(72) Inventors: Thomas Hentschel, Bonn (DE); Olaf Engler, Bonn (DE); Henk-Jan Brinkman, Bonn (DE)

(73) Assignee: Hydro Aluminium Rolled Products GmbH, Grevenbroich (DE)

( * ) Notice: Subject to any disclaimer, the term of this patent is extended or adjusted under 35 U.S.C. 154(b) by 597 days.

This patent is subject to a terminal disclaimer.

(21) Appl. No.: 14/625,071

(22) Filed: Feb. 18, 2015

(65) Prior Publication Data

US 2015/0159251 A1 Jun. 11, 2015
US 2016/0273084 A2 Sep. 22, 2016

Related U.S. Application Data

(63) Continuation of application No. PCT/EP2013/067484, filed on Aug. 22, 2013.

(30) Foreign Application Priority Data

Aug. 22, 2012 (EP) ..... 12 181 356

(51) Int. Cl.
*C22F 1/047* (2006.01)
*C22C 21/08* (2006.01)
*C22C 21/06* (2006.01)

(52) U.S. Cl.
CPC ..... *C22F 1/047* (2013.01); *C22C 21/06* (2013.01); *C22C 21/08* (2013.01)

(58) Field of Classification Search
CPC ..... C22C 21/06; C22C 21/08; C22F 1/047
See application file for complete search history.

(56) References Cited

U.S. PATENT DOCUMENTS 4,081,294 A 3/1978 Thompson et al.
4,151,013 A 4/1979 Thompson et al.
(Continued)

FOREIGN PATENT DOCUMENTS

CA 2 417 573 A1 8/2003
DE 102 31 437 A1 2/2003
(Continued)

OTHER PUBLICATIONS

H.G. Suk et al., Development of Abnormal Grain Growth in Cold Rolled and Recrystallized AA 5182 Sheet, article, Solid State Phenomena, 2006, pp. 316-319, vols. 116-117, Trans Tech Publications, Switzerland.

(Continued)

*Primary Examiner* — George Wyszomierski
*Assistant Examiner* — Janell C Morillo
(74) *Attorney, Agent, or Firm* — Reinhart Boerner Van Deuren P.C.

(57) ABSTRACT

The invention relates to an aluminium alloy strip composed of an AA 5xxx-type aluminium alloy containing at least 4 wt. % of Mg in addition to Al and inevitable impurities. The object of the invention of proposing an aluminium alloy strip in an AlMg aluminium alloy strip which is resistant to intercrystalline corrosion despite having high strength and an Mg content of at least 4 wt. %, is achieved according to a first teaching of the present invention by an aluminium alloy strip that has a recrystallized microstructure, the grain size (GS) of which in μm has the following relation to the Mg content (c_Mg) in wt. % :

(Continued)

GS≥22+2*c_Mg, and wherein the aluminium alloy of the aluminium alloy strip has the composition described herein.

19 Claims, 3 Drawing Sheets

(56) References Cited

U.S. PATENT DOCUMENTS

| | | | | |
|---|---|---|---|---|
| 4,186,034 | A | 1/1980 | Akeret | |
| 5,104,459 | A | 4/1992 | Chen et al. | |
| 5,423,925 | A * | 6/1995 | Shoji | C22C 21/06 148/552 |
| 5,516,374 | A * | 5/1996 | Habu | C22C 21/06 148/439 |
| 2003/0150587 | A1 | 8/2003 | Li et al. | |
| 2004/0261922 | A1 | 12/2004 | Van Der Hoeven et al. | |
| 2007/0125465 | A1 | 6/2007 | Kehl et al. | |

FOREIGN PATENT DOCUMENTS

| | | | |
|---|---|---|---|
| EP | 0 690 141 | A1 | 1/1996 |
| EP | 0 690 142 | A1 | 1/1996 |
| GB | 2 027 621 | A | 2/1980 |
| JP | 55-027497 | A | 2/1980 |
| JP | 62-207850 | A | 9/1987 |
| JP | 06-145926 | A | 5/1994 |
| JP | 07-331374 | A | 12/1995 |
| JP | 08-090091 | A | 4/1996 |
| JP | 10-219412 | | 8/1998 |
| JP | 2001-032031 | A | 2/2001 |
| JP | 2004-250738 | A | 9/2004 |
| JP | 2008-190021 | A | 8/2008 |

OTHER PUBLICATIONS

P.Z. Zhao et al., Development of twin-belt cast AA5XXX series aluminum alloy materials for automotive sheet applications, article, Aluminum Alloys: Fabrication, Characterization and Applications II, 2009, pp. 11-17, TMS (The Minerals, Metals & Materials Society).

S. Lin et al., Hot-Tear Susceptibility of Aluminum Wrought Alloys and the Effect of Grain Refining, article, Metallurgical and Material Transactions, May 2007, pp. 1056-1068, vol. 38A, The Minerals, Metals & Materials Society and ASM International.

K.J. Kim et al., Formability of AA5182/polypropylene/AA5182 sandwich sheets, journal, Journal of Materials Processing Technology 139, 2003, pp. 1-7, Elsevier Science B.V.

W.C. Liu et al., Comparison of recrystallization and recrystallization of textures in coldrolled DC and CC AA 5182 aluminum alloys, article, Materials Science and Engineering A358, 2003, pp. 84-93, Elsevier Science B.V.

Dianyuan Huang, Temperature Deformation Behavior and Drawing Performance of 5182 Aluminum Alloy for Vehicles, Chinese Master's Theses Full-text Database—Engineering Science and Technology I, Jan. 15, 2009, 7 pages, Issue 1.

J. Li et al., "Comparison of earing behavior between continuous cast and direct chill cast AA 5182 aluminum alloys during cold rolling and annealing", Journal of Materials Processing Technology, Jul. 17, 2010, 9 pages.

Wei Wen et al., "The effect of cold rolling and annealing on the serrated yielding phenomenon of AA5182 aluminum alloy", Materials Science and Engineering, Jan. 13, 2004, 13 pages.

Reinhold Braun et al., "Effects of cold working and thermal exposure on the SCC behaviour of AA5182 allow sheet", Materials Science Forum, May 2, 1996, vols. 217-222, 6 pages.

Aluminium-Verlag; "Aluminium Taschenbuch 1"; ISBN 3-87017-274-6; Dusseldorf, 2002, 16. Auflage; 5 pages.

Extreme Elektronische Auslegestelle-Beuth-Hochschulbibliothekszenstrum Des Landes Nordrhein-Westfalen; DIN EN ISO 18265:2014-02; EN ISO 18265"2013 (D); Jan. 31, 2018; 5 pages.

Christian Vargel; "Corrosion de l'aluminium"; ISBN 2100041916; Dunod, Paris; 1999; 6 pages.

W.C. Liu et a..; "Comparison of recrystallization and recrystallization textures in coldrolled DC and CC AA 5182 aluminum alloys"; Materials Science and Engineering A358 (2003), 10 pages.

Aluminium-Verlag; Aluminium Handbook 2—vol. 2, first edition; ISBN 3-87017-262-2; 2003; 6 pages.

Aluminium-Verlag; Aluminium Handbook 1—vol. 1, first edition; ISBN 3-87017-261-4; 1999; Dusseldorf, DE; 3 pages.

Kristen Lynn Deffenbaugh; "Grain size control in AA5083: Thermomechanical processing and particle stimulated nucelation"; Calhoun Institutional Archive of the Naval Postgraduate School; Jun. 2004; http://hdl.handle.net/10945/1162; 66 pages.

The Aluminum Association, Inc.; International Alloy Designations and Chemical Composition Limits for Wrought Aluminum and Wrought Aluminum Alloys; Registration Record Series Teal Sheets; Arlington, VA; Jan. 2015; 38 pages.

Olaf Engler et al.; "Control of recrystallization texture and texture-related properties in industrial production of aluminium sheet"; International Journal of Materials Research; 2009; 12 pages.

Aluminium—Verlag; "Aluminium-Taschenbuch, 14. Auflage"; Dusseldorf, DE, 3 pages.

Declaration/Affidavit of Gilles Guiglionda, Jan. 31, 2019, 3 pages.

ASM Specialty Handbook, Aluminum and Aluminum Alloys, Handbook, Dec. 1993, pp. 43 and 678 (4 pages).

The Aluminum Association, Registration Records Series Teal Sheets, International Alloy Designations and Chemical Composition Limits for Wrought Aluminum and Wrought Aluminum Alloys, Feb. 2009, 35 pages.

* cited by examiner

INTERCRYSTALLINE CORROSION-RESISTANT ALUMINIUM ALLOY STRIP, AND METHOD FOR THE PRODUCTION THEREOF

CROSS-REFERENCE TO RELATED PATENT APPLICATIONS

This patent application is a continuation of PCT/EP2013/067484, filed Aug. 22, 2013, which claims priority to European Application No. 12 181 356.2, filed Aug. 22, 2012, the entire teachings and disclosures of which are incorporated herein by reference thereto.

FIELD OF THE INVENTION

The invention relates to an aluminium alloy strip composed of an AA 5xxx-type aluminium alloy, which apart from Al and unavoidable impurities has an Mg content of at least 4 wt. %. The invention also relates to a method for the production of the aluminium alloy strip according to the invention and a component produced from an aluminium alloy strip according to the invention.

BACKGROUND OF THE INVENTION

Aluminium-magnesium-(AlMg—)-alloys of the AA 5xxx-type are used in the form of sheets or plates or strips for the construction of welded or joined structures in ship, automotive and aircraft construction. They are in particular characterised by high strength which increases as the magnesium content rises.

For example, from the article entitled *Development of twin-belt cast AA5XXX series aluminium alloy materials for automotive sheet applications* by Zhao et al., an aluminium strip is known composed of an AA5182-alloy with an Mg content of 4.65 wt. % which is suitable for use in automotive construction.

Aluminium alloy strips of the AA5182-type with an Mg content of at least 4 wt. % are similarly known from the article entitled *Semi-Solid Processing of Alloys and Composites* by Kang et al. and from the article entitled *Comparison of recrystallization textures in cold-rolled DC and CC AA* 5182 *aluminum alloys* by Liu et al., as well as from US 2003/0150587 A1. The article entitled *Hot-Tear Susceptibility of Aluminium Wrought Alloys and the Effect of Grain Refining* by Lin et al. concerns round bars in an AA5182 alloy.

DE 102 31 437 A1 concerns corrosion-resistant aluminium alloy sheet, wherein through the addition of Zn in an amount of more than 0.4 wt. % sufficient resistance to intercrystalline corrosion is achieved.

Furthermore, published document GB 2 027 621 A discloses a method for manufacturing an aluminium strip.

AlMg-alloys of the AA 5xxx-type with Mg contents of more than 3%, in particular more than 4%, have an increasing tendency towards intercrystalline corrosion, when exposed to high temperatures. At temperatures of 70-200° C. $\beta$-$Al_5Mg_3$ phases precipitate along the grain boundaries, which are referred to as $\beta$-particles and in the presence of a corrosive medium can be selectively dissolved. The result of this is that the AA 5182-type aluminium alloy (Al 4.5% Mg 0.4% Mn) having particularly good strength properties and very good formability cannot be used in heat-stressed areas, where the presence of a corrosive medium such as water in the form of moisture must be contended with. This concerns in particular the components of a motor vehicle which normally undergo cathode dip painting (CDP) and are then dried in a stoving process, as already due to this stoving process, normal aluminium alloy strips can become susceptible to intercrystalline corrosion. Furthermore, for use in the automotive sector, forming during the manufacture of a component and subsequent operational stressing of the component must be taken into consideration.

The susceptibility to intercrystalline corrosion is normally checked in a standard test according to ASTM G67, during which the specimens are exposed to nitric acid and the mass loss based on the dissolution of $\beta$-particles is measured. According to ASTM G67 the mass loss of materials which are not resistant to intercrystalline corrosion, is more than 15 $mg/cm^2$.

Such materials and aluminium strips are therefore unsuitable for use in heat-stressed areas.

SUMMARY OF THE INVENTION

On this basis, the object of the present invention is to propose an aluminium alloy strip composed of an AlMg alloy, which despite high strength and an Mg content of more than 4 wt. %, in particular also after forming and a subsequent application of heat, is resistant to intercrystalline corrosion. A method for production will also be indicated, with which aluminium strips resistant to intercrystalline corrosion can be produced. Finally, components of a motor vehicle which are resistant to intercrystalline corrosion, such as body parts or body accessories, such as doors, bonnets and tailgates or other structural parts, but also component parts, composed of an AA 5xxx-type aluminium alloy will be proposed.

According to a first teaching of the present invention, the abovementioned object is achieved by an aluminium alloy strip having a recrystallized microstructure, wherein the grain size (GS) of the microstructure in μm satisfies the following dependency on the Mg content (c_Mg) in wt. %:

$$GS>22+2*c_Mg.$$

and wherein the aluminium alloy of the aluminium alloy strip has the following composition in wt. %:

$Si \leq 0.2\%$,
$Fe \leq 0.35\%$,
$0.04\% \leq Cu \leq 0.08\%$,
$0.2\% \leq Mn \leq 0.5\%$.
$4.35\% \leq Mg \leq 4.8\%$,
$Cr \leq 0.1\%$,
$Zn \leq 0.25\%$,
$Ti \leq 0.1\%$, the remainder being Al and inevitable impurities, amounting to a maximum of 0.05 wt. % individually and a maximum of 0.15 wt. % in total.

At a Cu content of 0.04 wt. % to 0.08 wt. %, it is found that copper is involved in an increase in strength, but does not reduce the corrosion resistance too sharply. In addition, as a result of restricting the Mg range to between 4.35 wt. % and 4.8 wt. %, very good strength at moderate grain size is achieved. Consequently, resistance to intercrystalline corrosion can also be achieved in a particularly reliable manner, since the necessary grain sizes of the structure can be reliably obtained in the method.

An aluminium alloy strip with a recrystallized microstructure can be prepared from hot-rolled strip or soft-annealed cold-rolled strip. Extensive investigations have shown that there is a relationship between the grain size, the magnesium content and the resistance to intercrystalline corrosion. Since the grain size of a material is always given as a distribution, all grain sizes mentioned relate to the average grain size. The average grain size can be determined according to ASTM E1382. Where the grain size is sufficiently large, that is to say that provided the grain size is greater than or equal to the lower limit according to the invention of the grain size in relation to the Mg content of the aluminium alloy strip, a resistance to intercrystalline corrosion can be achieved, so that the mass loss in the ASTM G67 test drops to below 15 $mg/cm^2$. Such aluminium strips can therefore be described as resistant to intercrystalline corrosion. This has been demonstrated for the abovementioned aluminium strips in the unformed stated after a simulated CDP cycle including subsequent operational stressing for a maximum of 500 hours at 80° C. The resistance to intercrystalline corrosion has also been demonstrated for the abovementioned strips, when prior to the CDP cycle and the operational stressing the material is stretched by 15%, in order to simulate the forming into a component. Ultimately the aluminium alloy strip according to the invention, because of its relatively high Mg content, offers high strengths and yield points and at the same time is resistant to intercrystalline corrosion. It is therefore well-suited to use in heat-stressed areas in automotive construction.

If the grain size according to a next embodiment of the aluminium alloy strip according to the invention also meets the following condition:

$$GS<(253/(265-50*c_Mg))^2$$

with GS in μm and c_Mg in wt. %,
it can be ensured that the yield point $R_{p0.2}$ of the aluminium alloy strip is greater than 110 MPa. Here, the tensile strength of the strip is normally above 255 MPa.

A further advantageous configuration of the aluminium alloy strip is achieved in that the aluminium alloy of the aluminium alloy strip has the following composition in wt. %:

Si≤0.2%,
Fe≤0.35%,
0.04%≤Cu≤0.08%,
0.2%≤Mn≤0.5%,
4.45%≤Mg≤4.8%,
Cr≤0.1%,
Zn≤0.25%,
Ti≤0.1%, the remainder being Al and inevitable impurities, amounting to a maximum of 0.05 wt. % individually and a maximum of 0.15 wt. % in total. By restricting the Mg range to between 4.45 wt. % and 4.8 wt. %, very good strength at moderate grain size is similarly achieved.

According to a next configuration of the aluminium alloy strip according to the invention, the grain size is at its maximum at 50 μm, since when producing aluminium strips with grain sizes of more than 50 μm from an AA 5xxx-type aluminium alloy with an Mg content of at least 4 wt. % the process reliability is reduced. However, a grain size with a maximum of 50 μm can be reliably achieved. The process stability for producing structures with a controlled grain size increases as the grain size is reduced. Thus, the production of an aluminium alloy strip with a maximum grain size of 45 μm, preferably a maximum of 40 μm, is associated with increasing process stability.

According to a next configuration of the aluminium alloy strip according to the invention, this has a thickness of 0.5 mm-5 mm and is therefore ideally suited to most applications, for example in automotive construction.

Furthermore, the aluminium alloy strip can be advantageously configured by being cold-rolled and finally soft-annealed. Recrystallizing soft-annealing normally takes place at temperatures of 300° C.-500° C. and allows the solidifications introduced during the rolling process to be removed and good formability of the aluminium alloy strip to be ensured. Furthermore, with cold-rolled, soft-annealed and therefore recrystallized strips lower final thicknesses can be provided than with recrystallized hot-rolled strips.

Finally, the aluminium alloy strip according to a further configuration has a yield point $R_{p0.2}$ of greater than 120 MPa and a tensile strength $R_m$ of greater than 260 MPa. Thus, the aluminium alloy according to the invention resistant to intercrystalline corrosion also exceeds the strength properties required according to DIN485-2 for an AA5182-type aluminium alloy. Thus, the strain values with a uniform elongation $A_g$ of at least 19% and an elongation at rupture $A_{80mm}$ of at least 22% also far exceed the values required by DIN485-2.

According to a second teaching of the present invention, the object outlined above is achieved by a method for producing an aluminium alloy strip comprising the following process steps:

- casting a rolling ingot composed of an aluminium alloy composition according to the invention;
- homogenisation of the rolling ingot at 480° C. to 550° C. for at least 0.5 hours;
- hot rolling of the rolling ingot at a temperature of 280° C. to 500° C.;
- cold rolling of the aluminium alloy strip to the final thickness with a degree of rolling of less than 40%, preferably a maximum of 30%, particularly preferably a maximum of 25%;
- soft annealing of the finished-rolled aluminium alloy strip at 300° C. to 500° C.

In sum, the process steps listed, because of the low degree of rolling with cold-rolling of the aluminium alloy strip to the final thickness, mean that a grain size after soft-annealing can be provided which meets the abovementioned condition for the Mg content. By means of the degree of rolling to the final thickness, the strain hardening of the strip prior to soft annealing can be set, which determines the resultant grain size. With a reducing degree of rolling of less than 40%, through a maximum of 30% and a maximum of 25%, different grain sizes are therefore set, which can be matched to the alloy composition. In this regard, an aluminium alloy strip can be produced which is resistant to intercrystalline corrosion.

According to a further configuration of the method according to the invention, after hot rolling alternatively the following process steps are performed:

- cold rolling of the hot-rolled aluminium alloy strip with a degree of rolling of at least 30%, preferably at least 50%;
- intermediate annealing of the aluminium alloy strip at 300° C. to 500° C.,
- subsequent cold rolling to the final thickness with a degree of rolling of less than 40%, preferably a maximum of 30%, particularly preferably a maximum of 25%;
- soft annealing of the finish-rolled aluminium alloy strip at 300° C. to 500° C.

A common feature of both the methods outlined above is that the degree of rolling prior to soft annealing, that is to say the degree of rolling to the end thickness during the cold rolling, is restricted to less than 40%, preferably a maximum of 30%, particularly preferably a maximum of 25%. In the second configuration of the method according to the invention, an additional cold-rolling step takes place after an intermediate annealing at 300° C.-500° C. During the intermediate annealing, the aluminium alloy strip that has been hardened markedly by the cold rolling is recrystallized and converted again into a formable state. The subsequent cold rolling step with a degree of rolling of less than 40%, preferably a maximum of 30%, particularly preferably a maximum of 25%, means that in conjunction with the Mg contents used of the aluminium alloy the grain size can be set at the required ratio. Ultimately, then, in the soft-annealed state a strip can be produced which is both resistant to intercrystalline corrosion and also has the necessary forming and/or strength properties.

According to a next configuration of the method according to the invention, the soft annealing and/or the intermediate annealings take place in a batch furnace, in particular a chamber furnace, or a continuous furnace. Both furnaces result in the provision of a sufficiently coarse grain structure, which guarantees the resistance to intercrystalline corrosion. Batch furnaces are normally less cost-intensive to buy and run than continuous furnaces.

According to a third teaching of the present invention, the object outlined above is achieved by a component for a motor vehicle which is at least partially composed of an aluminium alloy strip according to the invention. The component normally undergoes painting, preferably cathode dip painting. Nevertheless, there are also usage possibilities for unpainted components produced from the aluminium alloy strip according to the invention.

As already stated above, the aluminium alloy strip has exceptional properties in terms of strength, formability and resistance to intercrystalline corrosion, so that in particular the thermal stressing of painting, in a stoving process which typically lasts 20 minutes at approximately 185° C., has little influence on the resistance of the component to intercrystalline corrosion. Forming into a component, simulated through stretching by 15% transversely to the original direction of rolling, also has only a slight effect on the resistance to intercrystalline corrosion. Even after 15% stretching the values for the mass loss according to ASTM G67 are less than 15 mg/cm$^2$. Furthermore, use in heat-stressed areas, simulated by thermal stressing for 200 or 500 hours at 80° C., had only a slight influence on the resistance to intercrystalline corrosion. The values for the mass loss according to ASTM G67, even after corresponding thermal stressing, are less than 15 mg/cm$^2$.

A component is particularly advantageous when this is designed as a body part or body accessory of a motor vehicle. Typical body parts are the fenders or parts of the floor assembly, the roof, etc. Body accessories are what doors and tailgates, etc. which are not rigidly connected to the motor vehicle, are usually referred to as. Non-visible body parts or body accessories are preferably produced from the aluminium alloy strip according to the invention. These are, for example, the internal door parts or internal tailgate parts but also floor panels, etc. Typical thermal stressing of such components of a motor vehicle, for example internal door parts, can for example be caused by solar irradiation while the vehicle is being used. Furthermore, body parts or accessories of a motor vehicle are generally also exposed to moisture, for example in the form of spray or condensation, so that resistance to intercrystalline corrosion must be demanded. The body parts or accessories according to the invention, produced from an aluminium alloy strip according to the present invention, meet these conditions and furthermore guarantee a weight advantage compared with the steel constructions used previously.

BRIEF DESCRIPTION OF THE DRAWINGS

In the following the invention will now be further explained by means of embodiments in association with the drawing. The drawing shows as follows.

DETAILED DESCRIPTION OF THE INVENTION

Figure 1:
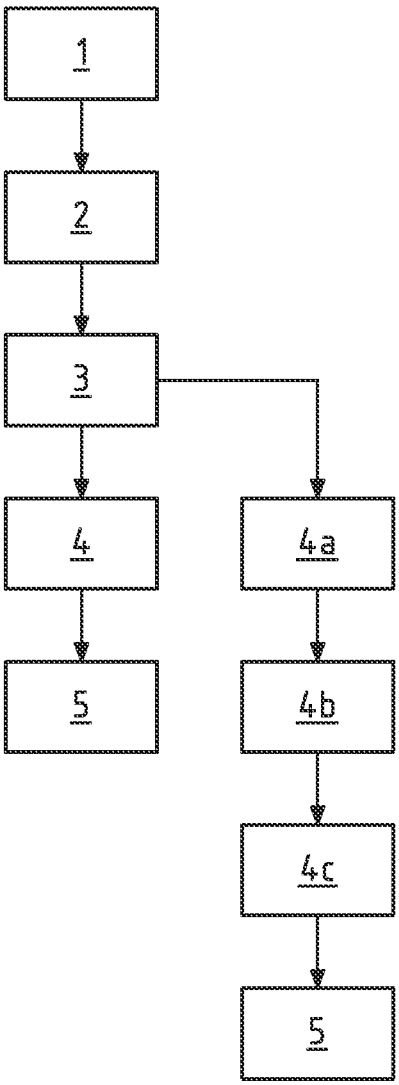
FIG. 1 shows a schematic flow diagram of an embodiment of a production process.

Extensive trials were carried out to investigate if there is a link between the grain size of an aluminium alloy strip in an AA 5xxx-type aluminium alloy and the Mg content in terms of the resistance to intercrystalline corrosion. To this end, various aluminium alloys were used and different process parameters applied. Table 1 shows the various alloy compositions, on the basis of which the relationship between grain size, resistance to intercrystalline corrosion and yield point was investigated. Apart from the contents of the alloying elements Si, Fe, Cu, Mn, Mg, Cr, Zn and Ti in wt. %, the aluminium alloys shown Table 1 comprise as remainder aluminium and inevitable impurities, each of which amounts to a maximum of 0.05 wt. % and the total amount of which amounts to no a maximum of 0.15 wt. %.

Since, in particular, the final annealing and the final degree of rolling have an influence on the grain size, these were varied and/or measured during the respective trials. The grain size varied for example from 16 μm to 61 μm, and the final degree of rolling from 17% to 57%. The final soft annealing was carried out either in the chamber furnace (KO) or in the continuous belt furnace (BDLO).

TABLE 1

| No | Alloy | Degree of final rolling [%] | Final annealing | Grain size [μm] | Si | Fe | Cu | Mn | Mg | Cr | Zn | Ti |
|---|---|---|---|---|---|---|---|---|---|---|---|---|
| 1 | III | 46 | KO | 16 | 0.07 | 0.24 | 0.040 | 0.30 | 4.50 | 0.005 | 0.007 | 0.016 |
| 2 | V | 57 | BDLO | 17 | 0.05 | 0.17 | 0.023 | 0.26 | 4.95 | 0.008 | 0.003 | 0.026 |
| 3 | IV | 35 | BDLO | 20 | 0.10 | 0.30 | 0.077 | 0.33 | 4.71 | 0.020 | 0.009 | 0.015 |
| 4 | I | 45 | KO | 21 | 0.03 | 0.13 | 0.002 | 0.25 | 4.15 | 0.001 | 0.004 | 0.021 |
| 5 | IV | 30 | BDLO | 23 | 0.10 | 0.30 | 0.077 | 0.33 | 4.71 | 0.020 | 0.009 | 0.015 |
| 6 | IV | 25 | BDLO | 25 | 0.10 | 0.30 | 0.077 | 0.33 | 4.71 | 0.020 | 0.009 | 0.015 |
| 7 | IV | 35 | KO | 26 | 0.10 | 0.30 | 0.077 | 0.33 | 4.71 | 0.020 | 0.009 | 0.015 |
| 8 | IV | 20 | BDLO | 29 | 0.10 | 0.30 | 0.077 | 0.33 | 4.71 | 0.020 | 0.009 | 0.015 |
| 9 | V | 21 | BDLO | 30 | 0.05 | 0.17 | 0.023 | 0.26 | 4.95 | 0.008 | 0.003 | 0.026 |

TABLE 1-continued

| No | Alloy | Degree of final rolling [%] | Final annealing | Grain size [μm] | Si | Fe | Cu | Mn | Mg | Cr | Zn | Ti |
|---|---|---|---|---|---|---|---|---|---|---|---|---|
| 10 | III | 30 | KO | 30 | 0.07 | 0.24 | 0.040 | 0.30 | 4.50 | 0.005 | 0.007 | 0.016 |
| 11 | I | 25 | BDLO | 31 | 0.03 | 0.13 | 0.002 | 0.25 | 4.15 | 0.001 | 0.004 | 0.021 |
| 12 | IV | 30 | KO | 32 | 0.10 | 0.30 | 0.077 | 0.33 | 4.71 | 0.020 | 0.009 | 0.015 |
| 13 | II | 21 | BDLO | 33 | 0.06 | 0.16 | 0.004 | 0.27 | 4.35 | 0.008 | 0.002 | 0.013 |
| 14 | III | 25 | KO | 34 | 0.07 | 0.24 | 0.040 | 0.30 | 4.50 | 0.005 | 0.007 | 0.016 |
| 15 | I | 20 | BDLO | 34 | 0.03 | 0.13 | 0.002 | 0.25 | 4.15 | 0.001 | 0.004 | 0.021 |
| 16 | IV | 25 | KO | 36 | 0.10 | 0.30 | 0.077 | 0.33 | 4.71 | 0.020 | 0.009 | 0.015 |
| 17 | IV | 20 | KO | 39 | 0.10 | 0.30 | 0.077 | 0.33 | 4.71 | 0.020 | 0.009 | 0.015 |
| 18 | III | 17 | BDLO | 43 | 0.07 | 0.24 | 0.040 | 0.30 | 4.50 | 0.005 | 0.007 | 0.016 |
| 19 | III | 17 | KO | 61 | 0.07 | 0.24 | 0.040 | 0.30 | 4.50 | 0.005 | 0.007 | 0.016 |

FIG. 1 shows the sequence of embodiments for the production of aluminium strips. The flow diagram of FIG. 1 is a schematic representation of the various process steps of the production process of the aluminium alloy strip according to the invention.

In step 1, a rolling ingot of an AA 5xxx-type aluminium alloy with an Mg content of at least 4 wt. % is cast, for example in DC continuous casting. Then the rolling ingot in process step 2 undergoes homogenisation, which can be performed in one or more stages. During homogenisation, temperatures of the rolling ingot of 480 to 550° C. are reached for at least 0.5 hours. In process step 3, the rolling ingot is then hot rolled, wherein typically temperatures of 280° C. to 500° C. are reached. The final thicknesses of the hot-rolled strip are, for example, 2 to 12 mm. Here, the hot-rolled strip thickness can be selected such that after hot rolling only a single cold rolling step 4 takes place, in which the hot-rolled strip, with a degree of rolling of less than 40%, preferably a maximum of 30%, particularly preferably a maximum of 25%, is reduced in its thickness.

Then the aluminium alloy strip that has been cold-rolled to its final thickness undergoes soft annealing. The soft annealing was performed in a continuous furnace or in a chamber furnace in order to test the dependency of the corrosion properties on the chamber or continuous furnace. In the embodiments shown in Table 1, the second route was applied with an intermediate annealing. For this, the hot-rolled strip after hot rolling according to process step 3 is passed for cold rolling 4*a*, having a degree of rolling of more than 30% or more than 50%, so that the aluminium alloy strip in a subsequent intermediate annealing preferably thoroughly recrystallizes. The intermediate annealing was carried out in the embodiments either in the continuous furnace at 400° C. to 450° C. or in the chamber furnace at 330° C. to 380° C.

The intermediate annealing is shown in FIG. 1 by process step 4b. In process step 4*c* according to FIG. 1, the intermediately-annealed aluminium alloy strip is finally passed for cold rolling to the final thickness, wherein the degree of rolling in process step 4*c* is less than 40%, preferably a maximum of 30%, particularly preferably a maximum of 25%. Then the aluminium alloy strip is again converted to the soft state by soft annealing, wherein the soft annealing is carried out either in the continuous furnace at 400° C. to 450° C. or in the chamber furnace at 330° C. to 380° C. During the various trials, apart from the different aluminium alloys, various degrees of rolling after the intermediate annealing were set. The values for the degree of rolling after the intermediate annealing are likewise shown in Table 1. In addition, in each case the grain size of the soft-annealed aluminium alloy strip was measured.

The aluminium alloy strips manufactured in this way had their mechanical characteristics determined, in particular the yield point $R_{p0.2}$, tensile strength $R_m$, the uniform elongation Ag and the elongation at rupture $A_{80mm}$. Furthermore, the corrosion resistance to intercrystalline corrosion in accordance with ASTM G67 was measured, and in fact without additional heat treatment in the initial state (at 0 h). Apart from the mechanical characteristics of the aluminium alloy strips measured according to EN 10002-1 or ISO 6892, in addition the grain sizes calculated according to the formulas (1) shown below for resistance to intercrystalline corrosion and (2) for achieving the necessary mechanical properties, in particular a sufficiently high yield point, are shown in Table 2 as column GS(IK) and as column GS(Rp). The grain sizes were determined according to ASTM E1382 and are expressed in μm.

TABLE 2

| | | IK-mass loss, unstretched** [mg/cm²] | | | | IK- mass loss, 15% stretched ** [mg/cm²] | | Mechanical properties, soft state | | | | | | |
|---|---|---|---|---|---|---|---|---|---|---|---|---|---|---|
| No | Al-alloy | Initial (Oh) | 20 min. 185° C. | 20 min. 185° + 200 h 80° C. | 20 min. 185° + 500 h 80° C. | 20 min. 185° C. | 20 min. 185° + 200 h 80° C. | $R_{po,2}$ [MPa] | $R_m$ [MPa] | Ag [%] | $A_{80\,mm}$ [%] | GS(IK) 22 + 2*c_Mg [μm] | GS(Rp) (253/(265-50*c_Mg))² [μm] | Result |
| 1 | III | 15.4 | 16.6 | 25.7 | 26.9 | 18.8 | 33.6 | 135 | 279 | 20.7 | 25.2 | 31.0 | 40.0 | IK too high |
| 2 | V | 1.3 | 5.3 | 41.7 | — | — | — | 141 | 286 | 22.6 | 27.1 | 31.9 | 209.0 | IK too high |
| 3 | IV | 1.1 | 1.9 | 27.8 | 33.0 | 3.8 | 33.9 | 131 | 287 | 22.0 | 25.0 | 31.4 | 73.6 | IK too high |
| 4 | I | 8.2 | 10.8 | 18.6 | 22.1 | 9.6 | 20.7 | 106 | 250 | 23.8 | 26.7 | 30.3 | 19.4 | IK too high |
| 5 | IV | 1.1 | 1.7 | 22.2 | 29.4 | 3.3 | 27.2 | 127 | 287 | 22.3 | 25.6 | 31.4 | 73.6 | IK too high |
| 6 | IV | 1.1 | 1.7 | 15.6 | 23.3 | 2.9 | 21.5 | 124 | 284 | 20.3 | 23.0 | 31.4 | 73.6 | IK too high |
| 7 | IV | 3.1 | 3.2 | 6.8 | 10.6 | 5.9 | 17.9 | 134 | 292 | 20.7 | 23.3 | 31.4 | 73.6 | IK too high |

TABLE 2-continued

| No | Al-alloy | IK-mass loss, unstretched** [mg/cm²] Initial (Oh) | 20 min. 185° C. | 20 min. 185° + 200 h 80° C. | 20 min. 185° + 500 h 80° C. | IK- mass loss, 15% stretched ** [mg/cm²] 20 min. 185° C. | 20 min. 185° + 200 h 80° C. | Mechanical properties, soft state $R_{po,2}$ [MPa] | $R_m$ [MPa] | Ag [%] | $A_{80\,mm}$ [%] | GS(IK) 22 + 2*c_Mg [μm] | GS(Rp) (253/(265-50*c_Mg))² [μm] | Result |
|---|---|---|---|---|---|---|---|---|---|---|---|---|---|---|
| 8 | IV | 1.1 | 1.6 | 11.6 | 16.3 | 2.6 | 15.0 | 121 | 284 | 21.3 | 24.9 | 31.4 | 73.6 | IK too high |
| 9 | V | 1.2 | 2.2 | 14.9 | 18.0 | — | — | 125 | 282 | 22.2 | 26.0 | 31.9 | 209.0 | IK too high |
| 10 | III | 2.8 | 3.0 | 7.9 | 10.9 | 6.4 | 18.0 | 125 | 281 | 19.5 | 23.6 | 31.0 | 40.0 | IK too high |
| 11 | I | 1.1 | 1.3 | 10.8 | 13.1 | 1.9 | 14.2 | 103 | 252 | 21.6 | 26.1 | 30.3 | 19.4 | According to the invention |
| 12 | IV | | 2.8 | | 8.9 | 4.6 | | 131 | 289 | | 21.6 | | | According to the invention |
| 13 | II | 1.2 | 1.7 | 10.4 | 12.5 | 4.4 | 12.9 | 109 | 259 | 22.0 | 24.6 | 30.7 | 28.4 | According to the invention |
| 14 | III | | | 6.7 | 8.8 | 4.5 | | 122 | 278 | | 22.8 | | 40.0 | According to the invention |
| 15 | I | 1.1 | 1.2 | 8.3 | 11.1 | 1.7 | 12.4 | 101 | 251 | 20.8 | 25.1 | 30.3 | 19.4 | According to the invention |
| 16 | IV | | | | 6.6 | 3.8 | 10.0 | 127 | 287 | | | | | According to the invention |
| 17 | IV | 1.8 | | | | 2.6 | 6.4 | 122 | 284 | | | | | According to the invention |
| 18 | III | 1.1 | 1.3 | 6.6 | 9.2 | 1.8 | 9.2 | 109 | 273 | 20.4 | 25.6 | 31.0 | 40.0 | According to the invention |
| 19 | III | 1.6 | 1.6 | 2.7 | 3.8 | 2.0 | 4.2 | 108 | 273 | 20.4 | 25.2 | 31.0 | 40.0 | According to the invention |

IK = intercrystalline corrosion

In order to simulate use in a motor vehicle, the aluminium alloy strips, prior to the corrosion test, furthermore underwent various heat treatments. A first heat treatment consisted of storage of the aluminium strips for 20 minutes at 185° C., in order to model the CDP cycle. In a further series of measurements, the aluminium alloy strips were also stored for 200 hours or 500 hours at 80° C. and then underwent the corrosion test. Since the forming of aluminium alloy strips or sheets can also affect the corrosion resistance, the aluminium alloy strips were stretched in a further trial by approximately 15%, and underwent heat treatment or storage at raised temperature and then a test for intercrystalline corrosion according to ASTM G67, during which the mass loss was measured.

It was apparent that there is a close relationship between the grain size, the Mg content and the resistance to intercrystalline corrosion. Embodiments 11 to 19 can all be classified as resistant to intercrystalline corrosion. This also applies to their use in motor vehicles with thermal stressing and the presence of moisture or a corrosive medium. In addition, embodiments 12, 14, 16 and 17 demonstrated the mechanical characteristics required according to DIN EN 485-2 for an AA 5182-type aluminium alloy strip.

Figure 2:
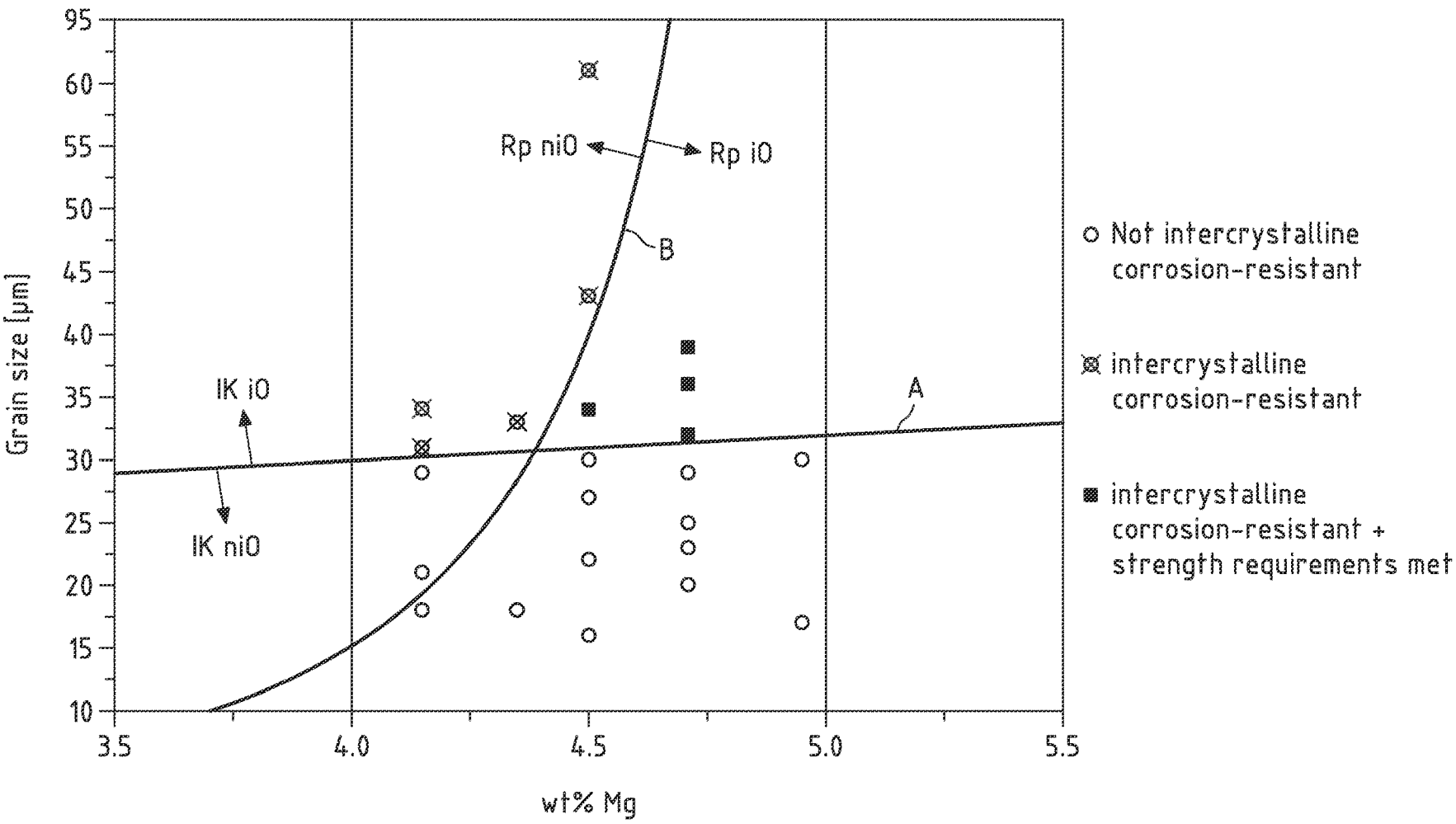
FIG. 2 shows a diagram with the grain size as a function of the magnesium content of the embodiments.

In FIG. 2, the diagram shows the measured grain sizes as a function of the Mg content in wt. %. Apart from the measurement points, the diagram also shows the curves A and B. The line A shows the grain sizes, above which at a specific Mg content: the aluminium alloy strip can be described as resistant to intercrystalline corrosion. The corresponding grain size (GS) is given by the following equation:

$$GS=22+2*c_Mg, \quad (1)$$

where c_Mg is the Mg content in wt. %.

The curve B, on the other hand, shows the limits beyond which the aluminium alloy strips have a yield point that is too low, of less than 110 MPa, so that these cannot be considered as an AA 5182 alloy according to DIN EN485-2. Curve B is determined by the following equation:

$$GS=\left(\frac{253}{265-50*c_Mg}\right)^2$$

All embodiments to the right of curve B therefore meet the requirement of a yield point of greater than 110 MPa.

Figure 3:
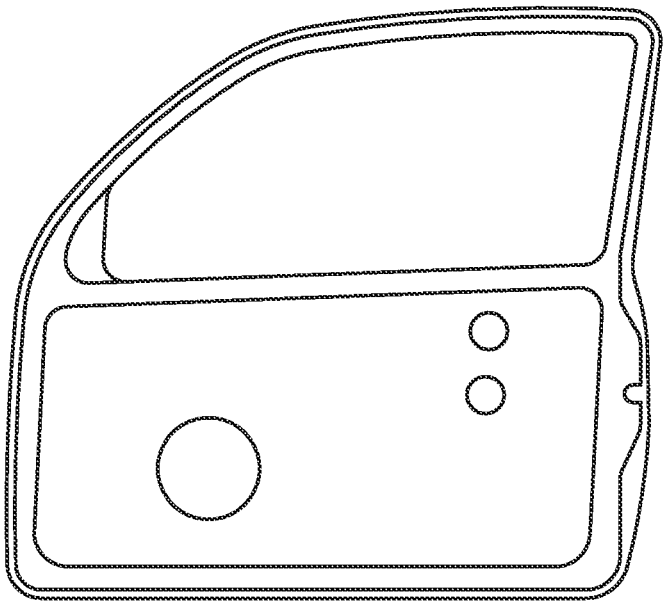
FIG. 3 shows a component for a motor vehicle according to a further embodiment.

Finally, FIG. 3 shows a typical component of a motor vehicle, in the form of an internal door part in schematic representation. Internal door parts 6 are normally produced from steel. However, the aluminium alloy strips produced show that the provision of high strengths and a resistance to intercrystalline corrosion can be achieved, where the grain size ratio is set in relation to the Mg content in accordance with the invention. The component according to the invention shown in FIG. 3 has a considerably lower weight than a comparable component in steel and is nevertheless resistant to intercrystalline corrosion.

The invention claimed is:

1. Aluminium alloy strip composed of an AA 5 xxx-type aluminium alloy, the aluminium alloy strip comprises a recrystallized microstructure, wherein the grain size (GS) of the recrystallized microstructure in μm satisfies the following dependency on the Mg content (c_Mg) in wt. %:

GS >22 +2*c_Mg, and wherein the maximum grain size is 45 μm and wherein the aluminium alloy of the aluminium alloy strip has the following composition in wt. %:

Si≤0.2%,

Fe≤0.35%, 0.04%≤Cu ≤0.08%, 0.2%≤Mn≤0.5%.

4.35%≤Mg≤4.8%,

Cr≤0.1%,
Zn≤0.25%,
Ti≤0.1%, the remainder being Al and inevitable impurities, amounting to a maximum of 0.05 wt. % individually and a maximum of 0.15 wt. % in total, wherein the aluminium alloy strip has a yield point $R_{p0.2}$ of greater than 120 MPa and a tensile strength $R_m$ of greater than 260 MPa.

2. The Aluminium alloy strip according to claim 1, wherein the grain size (GS) of the microstructure of the aluminium alloy strip also satisfies the following dependency on the Mg content (c_Mg) in wt. %:

$$GS < \left(\frac{253}{265 - 50 * c_Mg}\right)^2$$

3. The Aluminium alloy strip according to claim 1, wherein the aluminium alloy of the aluminium alloy strip has 4.45%≤Mg≤4.8%.

4. The Aluminium alloy strip according to claim 1, wherein the aluminium alloy strip has a thickness of 0.5 mm to 5 mm.

5. The Aluminium alloy strip according to claim 1, wherein the aluminium alloy strip is cold rolled and soft annealed.

6. A Component for a motor vehicle at least partially composed of an aluminium alloy strip according to claim 1.

7. The Component according to claim 6, wherein the component is a body part or a body accessory of a motor vehicle.

8. The Aluminium alloy strip according to claim 1, wherein the grain size is a maximum of 40 μm.

9. The Aluminium alloy strip according to claim 1, wherein the aluminium alloy strip experiences a mass loss of no more than 15 mg/cm$^2$ when tested according to ASTM G67.

10. A Method for producing an aluminium alloy strip according to claim 1 comprising the following process steps:

casting a rolling ingot;

homogenisation of the rolling ingot at 480° C. to 550° C. for at least 0.5 hours;

hot rolling of the rolling ingot at a temperature of 280° C. to 500° C.

cold rolling of the aluminium alloy strip to the final thickness with a degree of rolling of less than 40%; and soft-annealing of the finished-rolled aluminium alloy strip at 300° C. to 500° C.

11. The Method according to claim 10, wherein after the hot rolling alternatively the following process steps are carried out:

cold rolling of the hot-rolled aluminium alloy strip with a degree of rolling of at least 30%;

intermediate annealing of the aluminium alloy strip at between 300° C. and 500° C.;

subsequent cold rolling to the final thickness with a degree of rolling of less than 40%; and soft annealing of the finish-rolled aluminium alloy strip at between 300° C. and 500° C.

12. The Method according to claim 10, wherein the intermediate annealing and/or the soft annealing is/are carried out in a batch furnace or a continuous furnace.

13. The Method for producing an aluminium alloy strip according to claim 10, wherein the step of cold rolling comprises cold rolling of the aluminium alloy strip to the final thickness with a degree of rolling of a maximum of 30%.

14. The Method for producing an aluminium alloy strip according to claim 10, wherein the step of cold rolling comprises cold rolling of the aluminium alloy strip to the final thickness with a degree of rolling of a maximum of 25%.

15. The Method according to claim 10, wherein after the hot rolling alternatively the following process steps are carried out:

cold rolling of the hot-rolled aluminium alloy strip with a degree of rolling of at least 30%;

intermediate annealing of the aluminium alloy strip at between 300° C. and 500° C.;

subsequent cold rolling to the final thickness with a degree of rolling of a maximum of 30%; and soft annealing of the finish-rolled aluminium alloy strip at between 300° C. and 500° C.

16. The Method according to claim 10, wherein after the hot rolling alternatively the following process steps are carried out:

cold rolling of the hot-rolled aluminium alloy strip with a degree of rolling of at least 30%;

intermediate annealing of the aluminium alloy strip at between 300° C. and 500° C.;

subsequent cold rolling to the final thickness with a degree of rolling of a maximum of 25%; and soft annealing of the finish-rolled aluminium alloy strip at between 300° C. and 500° C.

17. The Method according to claim 10, wherein after the hot rolling alternatively the following process steps are carried out:

cold rolling of the hot-rolled aluminium alloy strip with a degree of rolling of at least 50%;

intermediate annealing of the aluminium alloy strip at between 300° C. and 500° C.;

subsequent cold rolling to the final thickness with a degree of rolling of less than 40%; and soft annealing of the finish-rolled aluminium alloy strip at between 300° C. and 500° C.

18. The Method according to claim 10, wherein after the hot rolling alternatively the following process steps are carried out:

cold rolling of the hot-rolled aluminium alloy strip with a degree of rolling of at least 50%;

intermediate annealing of the aluminium alloy strip at between 300° C. and 500° C.;

subsequent cold rolling to the final thickness with a degree of rolling of a maximum of 30%; and soft annealing of the finish-rolled aluminium alloy strip at between 300° C. and 500° C.

19. The Method according to claim 10, wherein after the hot rolling alternatively the following process steps are carried out:

cold rolling of the hot-rolled aluminium alloy strip with a degree of rolling of at least 50%;

intermediate annealing of the aluminium alloy strip at between 300° C. and 500° C.;

subsequent cold rolling to the final thickness with a degree of rolling of a maximum of 25%; and soft annealing of the finish-rolled aluminium alloy strip at between 300° C. and 500° C.

* * * * *